US009428919B2

(12) United States Patent
Pervan et al.

(10) Patent No.: US 9,428,919 B2
(45) **Date of Patent: *Aug. 30, 2016**

(54) MECHANICAL LOCKING SYSTEM FOR FLOOR PANELS

(71) Applicant: VÄLINGE INNOVATION AB, Viken (SE)

(72) Inventors: Darko Pervan, Viken (SE); Agne Pålsson, Hasslarp (SE)

(73) Assignee: VALINGE INNOVATION AB, Viken (SE)

( * ) Notice: Subject to any disclaimer, the term of this patent is extended or adjusted under 35 U.S.C. 154(b) by 84 days.

This patent is subject to a terminal disclaimer.

(21) Appl. No.: 14/294,230

(22) Filed: Jun. 3, 2014

(65) Prior Publication Data

US 2014/0260060 A1 Sep. 18, 2014
US 2015/0068151 A2 Mar. 12, 2015

Related U.S. Application Data

(63) Continuation of application No. 13/577,042, filed as application No. PCT/SE2011/050116 on Feb. 3, 2011, now Pat. No. 8,776,473.

(30) Foreign Application Priority Data

Feb. 4, 2010 (SE) ..... 1050111

(51) Int. Cl.
*E04F 15/02* (2006.01)
*E04F 13/08* (2006.01)

(52) U.S. Cl.
CPC ..... *E04F 15/02038* (2013.01); *E04F 13/0894* (2013.01); *E04F 2201/0115* (2013.01);

(Continued)

(58) Field of Classification Search
CPC ..... E04F 15/02038; E04F 2201/0176; E04F 2201/0523; E04F 2201/0558; E04F 2201/0588
See application file for complete search history.

(56) References Cited

U.S. PATENT DOCUMENTS 87,853 A 3/1869 Kappes
108,068 A 10/1870 Utley (Continued)

FOREIGN PATENT DOCUMENTS

CA 2456513 A1 2/2003
CN 201588375 U 9/2010

(Continued)

OTHER PUBLICATIONS

Pervan, Darko, et al., U.S. Appl. No. 14/463,972, entitled "Mechanical Locking of Floor Panels with a Flexible Bristle Tongue," filed in the U.S. Patent and Trademark Office on Aug. 20, 2014.

(Continued)

*Primary Examiner* — Ryan Kwiecinski
(74) *Attorney, Agent, or Firm* — Buchanan Ingersoll & Rooney P.C.

(57) ABSTRACT

Floor panels are shown, which are provided with a mechanical locking system comprising a tongue with rocker arms that allows locking by a vertical turning motion. The tongue has an inner part mounted in a sideward open fixation groove in a first edge and an outer part extending beyond a vertical plane, the inner part is fixed in the sideward open groove, wherein the tongue has at least one rocker arm extending in the length direction of the tongue, the rocker arm having a displaceable pressing protrusion that during locking is in contact with a second edge and a displaceable locking protrusion that in locked position cooperates with a tongue groove, wherein the locking protrusions are displaced outwardly away from the main tongue body when the pressing protrusion is pressed and displaced inwardly towards the inner part of the tongue.

15 Claims, 4 Drawing Sheets

(52) U.S. Cl.
CPC *E04F2201/0153* (2013.01); *E04F 2201/0176* (2013.01); *E04F 2201/027* (2013.01); *E04F 2201/0523* (2013.01); *E04F 2201/0535* (2013.01); *E04F 2201/0558* (2013.01); *E04F 2201/0588* (2013.01)

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,204,675 A 6/1940 Grunert
2,266,464 A 12/1941 Kraft
2,277,758 A 3/1942 Hawkins
2,430,200 A 11/1947 Wilson
2,596,280 A 5/1952 Nystrom
2,732,706 A 1/1956 Friedman
2,740,167 A 4/1956 Rowley
2,858,584 A * 11/1958 Gaines ..... E04F 13/0803 52/509
2,863,185 A 12/1958 Riedi
2,865,058 A 12/1958 Andersson
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,271,787 A 9/1966 Clary
3,325,585 A 6/1967 Brenneman
3,331,180 A * 7/1967 Vissing ..... E04B 9/22 411/457
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorne
4,819,932 A 4/1989 Trotter, Jr.
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,598,682 A 2/1997 Haughian
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,203,653 B1 3/2001 Seidner
6,254,301 B1 7/2001 Hatch
6,295,779 B1 10/2001 Canfield
6,314,701 B1 11/2001 Meyerson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.
6,591,568 B1 7/2003 Pålsson
6,601,359 B2 8/2003 Olofsson
6,617,009 B1 9/2003 Chen et al.
6,647,689 B2 11/2003 Pletzer
6,647,690 B1 11/2003 Martensson
6,651,400 B1 11/2003 Murphy
6,670,019 B2 12/2003 Andersson
6,681,820 B2 1/2004 Olofsson
6,685,391 B1 2/2004 Gideon
6,729,091 B1 5/2004 Martensson
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Gerhard
6,804,926 B1 10/2004 Eisermann

(56) References Cited

U.S. PATENT DOCUMENTS 6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 * 11/2008 Pervan ..... E04F 15/02 52/586.2
7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer et al.
7,930,862 B2 4/2011 Bergelin et al.
7,954,295 B2 6/2011 Pervan
7,980,039 B2 7/2011 Groeke
7,980,041 B2 7/2011 Pervan
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,234,830 B2 * 8/2012 Pervan ..... E04F 13/0894 52/582.1
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Pervan et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Darko et al.
8,938,929 B2 1/2015 Engström
8,959,866 B2 2/2015 Pervan
9,027,306 B2 5/2015 Pervan
9,051,738 B2 6/2015 Pervan et al.
9,068,360 B2 6/2015 Darko
9,194,134 B2 11/2015 Nygren et al.
9,238,917 B2 1/2016 Pervan et al.
9,284,737 B2 3/2016 Pervan et al.
9,309,679 B2 4/2016 Pervan et al.
9,316,002 B2 4/2016 Boo
2001/0024707 A1 9/2001 Andersson et al.
2002/0031646 A1 3/2002 Chen et al.
2002/0069611 A1 6/2002 Leopolder
2002/0092263 A1 7/2002 Schulte
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hanning
2004/0244325 A1 12/2004 Nelson
2004/0250492 A1 12/2004 Becker

(56) References Cited

U.S. PATENT DOCUMENTS

2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0236642 A1 10/2006 Pervan
2006/0260254 A1 11/2006 Pervan et al.
2006/0272262 A1 12/2006 Pomberger
2007/0006543 A1 1/2007 Engstrom
2007/0011981 A1 1/2007 Eiserman
2007/0028547 A1* 2/2007 Grafenauer ..... E04F 13/10 52/586.1
2007/0065293 A1 3/2007 Hannig
2007/0108679 A1 5/2007 Grothaus
2007/0151189 A1 7/2007 Yang et al.
2007/0175156 A1 8/2007 Pervan et al.
2007/0193178 A1* 8/2007 Groeke ..... E04F 15/02 52/578
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1* 5/2008 Pervan ..... E04F 15/02 52/582.2
2008/0134607 A1 6/2008 Pervan
2008/0134613 A1* 6/2008 Pervan ..... E04F 15/02 52/582.2
2008/0134614 A1 6/2008 Pervan
2008/0155930 A1 7/2008 Pervan et al.
2008/0216434 A1 9/2008 Pervan
2008/0216920 A1 9/2008 Pervan
2008/0236088 A1* 10/2008 Hannig ..... B27M 3/0066 52/592.1
2008/0295432 A1* 12/2008 Pervan ..... E04F 15/02038 52/395
2008/0302044 A1 12/2008 Johansson
2009/0019806 A1* 1/2009 Muehlebach ..... E04F 15/02 52/588.1
2009/0064624 A1 3/2009 Sokol
2009/0100782 A1 4/2009 Groeke et al.
2009/0133353 A1 5/2009 Pervan et al.
2009/0151290 A1 6/2009 Liu
2009/0173032 A1* 7/2009 Prager ..... F16B 5/0044 52/588.1
2009/0193741 A1 8/2009 Cappelle
2009/0193748 A1* 8/2009 Boo ..... B27F 1/02 52/589.1
2009/0193753 A1 8/2009 Schitter
2009/0217615 A1 9/2009 Engstrom
2009/0241460 A1 10/2009 Beaulieu
2009/0308014 A1* 12/2009 Muehlebach ..... E04F 15/02 52/592.4
2010/0043333 A1* 2/2010 Hannig ..... E04F 15/02 52/582.2
2010/0083603 A1 4/2010 Goodwin
2010/0170189 A1 7/2010 Schulte
2010/0173122 A1 7/2010 Susnjara
2010/0281803 A1 11/2010 Cappelle
2010/0293879 A1 11/2010 Pervan et al.
2010/0300031 A1 12/2010 Pervan et al.
2010/0319290 A1 12/2010 Pervan
2010/0319291 A1 12/2010 Pervan et al.
2011/0016815 A1 1/2011 Yang
2011/0030303 A1* 2/2011 Pervan ..... B27F 1/08 52/582.1
2011/0041996 A1 2/2011 Pervan
2011/0047922 A1* 3/2011 Fleming, III ..... B32B 3/06 52/582.1
2011/0088344 A1 4/2011 Pervan et al.
2011/0088345 A1 4/2011 Pervan
2011/0088346 A1 4/2011 Hannig
2011/0131916 A1* 6/2011 Chen ..... E04F 15/02 52/588.1
2011/0154763 A1 6/2011 Bergelin et al.
2011/0167750 A1 7/2011 Pervan
2011/0167751 A1* 7/2011 Engstrom ..... E04F 15/02 52/588.1
2011/0173914 A1 7/2011 Engström
2011/0197535 A1* 8/2011 Baker ..... E04B 1/6116 52/588.1
2011/0225921 A1 9/2011 Schulte
2011/0225922 A1 9/2011 Pervan et al.
2011/0252733 A1 10/2011 Pervan
2011/0271632 A1* 11/2011 Cappelle ..... E04F 15/02 52/582.2
2011/0283650 A1* 11/2011 Pervan ..... E04F 15/02 52/588.1
2012/0017533 A1* 1/2012 Pervan ..... E04F 15/02 52/588.1
2012/0031029 A1 2/2012 Pervan et al.
2012/0036804 A1 2/2012 Pervan
2012/0042598 A1 2/2012 Vermeulen et al.
2012/0055112 A1 3/2012 Engström
2012/0124932 A1 5/2012 Schulte et al.
2012/0151865 A1 6/2012 Pervan et al.
2012/0174515 A1 7/2012 Pervan
2012/0174520 A1 7/2012 Pervan
2012/0174521 A1* 7/2012 Schulte ..... F16B 5/0076 52/588.1
2012/0192521 A1 8/2012 Schulte
2012/0279161 A1 11/2012 Håkansson et al.
2012/0304590 A1 12/2012 Engström
2013/0008117 A1 1/2013 Pervan
2013/0014463 A1* 1/2013 Pervan ..... E04F 15/02038 52/588.1
2013/0019555 A1 1/2013 Pervan
2013/0042562 A1 2/2013 Pervan
2013/0042563 A1 2/2013 Pervan
2013/0042564 A1* 2/2013 Pervan ..... E04F 13/0894 52/588.1
2013/0042565 A1* 2/2013 Pervan ..... E04F 15/02038 52/588.1
2013/0047536 A1 2/2013 Pervan
2013/0081349 A1 4/2013 Pervan et al.
2013/0111837 A1 5/2013 Devos et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Darko et al.
2013/0263454 A1 10/2013 Boo et al.
2013/0263547 A1 10/2013 Boo
2013/0283719 A1 10/2013 Döhring et al.
2013/0318906 A1 12/2013 Pervan et al.
2014/0007539 A1 1/2014 Pervan et al.
2014/0020324 A1 1/2014 Pervan
2014/0033634 A1 2/2014 Pervan
2014/0053497 A1 2/2014 Pervan et al.
2014/0059966 A1 3/2014 Boo
2014/0069043 A1 3/2014 Pervan
2014/0090335 A1 4/2014 Pervan et al.

(56) References Cited

U.S. PATENT DOCUMENTS

| | | | |
|---|---|---|---|
| 2014/0109501 | A1 | 4/2014 | Darko |
| 2014/0109506 | A1 | 4/2014 | Pervan et al. |
| 2014/0123586 | A1 | 5/2014 | Pervan et al. |
| 2014/0130437 | A1 | 5/2014 | Cappelle |
| 2014/0144096 | A1 | 5/2014 | Vermeulen et al. |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0305065 | A1 | 10/2014 | Pervan |
| 2014/0366476 | A1 | 12/2014 | Pervan |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0059281 | A1 | 3/2015 | Pervan |
| 2015/0089896 | A2 | 4/2015 | Pervan et al. |
| 2015/0121796 | A1 | 5/2015 | Pervan |
| 2015/0167318 | A1 | 6/2015 | Pervan |
| 2015/0211239 | A1 | 7/2015 | Pervan |
| 2015/0233125 | A1 | 8/2015 | Pervan et al. |
| 2015/0267419 | A1 | 9/2015 | Pervan |
| 2015/0300029 | A1 | 10/2015 | Pervan |
| 2015/0330088 | A1* | 11/2015 | Derelov ..... E04F 15/02038 52/588.1 |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |

FOREIGN PATENT DOCUMENTS

| | | | |
|---|---|---|---|
| DE | 2 159 042 | | 6/1973 |
| DE | 33 43 601 | A1 | 6/1985 |
| DE | 33 43 601 | C2 | 6/1985 |
| DE | 39 32 980 | A1 | 11/1991 |
| DE | 42 15 273 | A1 | 11/1993 |
| DE | 42 42 530 | A1 | 6/1994 |
| DE | 196 01 322 | A | 5/1997 |
| DE | 299 22 649 | U1 | 4/2000 |
| DE | 200 01 788 | U1 | 6/2000 |
| DE | 199 40 837 | A1 | 11/2000 |
| DE | 199 58 225 | A1 | 6/2001 |
| DE | 202 05 774 | U1 | 8/2002 |
| DE | 203 20 799 | U1 | 4/2005 |
| DE | 10 2004 055 951 | A1 | 7/2005 |
| DE | 10 2004 001 363 | A1 | 8/2005 |
| DE | 10 2005 002 297 | A1 | 8/2005 |
| DE | 10 2004 054 368 | A1 | 5/2006 |
| DE | 10 2005 024 366 | A1 | 11/2006 |
| DE | 10 2006 024 184 | A1 | 11/2007 |
| DE | 10 2006 037 614 | B3 | 12/2007 |
| DE | 10 2006 057 491 | A1 | 6/2008 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 048 050 | B3 | 1/2011 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 000 610 | A1 | 12/2008 |
| EP | 2 017 403 | A2 | 1/2009 |
| EP | 2 034 106 | A1 | 3/2009 |
| EP | 2 333 195 | A1 | 6/2011 |
| EP | 2 570 564 | A2 | 3/2013 |
| EP | 2 333 195 | B1 | 7/2014 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51733 | A1 | 7/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | WO 2006/043893 | A1 | 4/2006 |
| WO | WO 2006/050928 | A1 | 5/2006 |

(56) References Cited

FOREIGN PATENT DOCUMENTS

| | | | |
|---|---|---|---|
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/070472 | A2 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/032540 | A2 | 3/2011 |
| WO | WO 2011/038709 | A1 | 4/2011 |
| WO | WO 01/51732 | A1 | 7/2011 |
| WO | WO 2011/085788 | A1 | 7/2011 |
| WO | WO 2011/127981 | A1 | 10/2011 |
| WO | WO 2011/151758 | A2 | 12/2011 |
| WO | WO 2013/025164 | A1 | 2/2013 |
| WO | WO 2013/087190 | A1 | 6/2013 |

OTHER PUBLICATIONS

Pervan, Darko, et al., U.S. Appl. No. 14/483,352, entitled "Mechanical Locking System for Floor Panels," filed in the U.S. Patent and Trademark Office on Sep. 11, 2014.

Pervan, Darko, U.S. Appl. No. 14/538,223, entitled "Mechanical Locking System for Floor Panels," filed in the U.S. Patent and Trademark Office on Nov. 11, 2014.

Pervan, Darko, U.S. Appl. No. 14/597,578 entitled "Mechanical Locking of Floor Panels with a Glued Tongue," filed in the U.S. Patent and Trademark Office on Jan. 15, 2015.

International Search Report mailed May 5, 2011 in PCT/SE2011/050116, Swedish Patent Office, Stockholm, Sweden, 5 pages.

Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.

Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.

Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.

Laminate Flooring Tips (http://flooring.lifetips.com/cat/61734/laminate-flooring-tips/index.html). Copyright 2000. 12 pages.

Pervan, Darko, U.S. Appl. No. 14/270,711, entitled "Mechanical Locking System for Floor Panels," filed May 6, 2014.

Pervan, Darko, U.S. Appl. No. 14/294,623, entitled "Mechanical Locking of Floor Panels with Vertical Folding," filed Jun. 3, 2014.

Boo, Christian, U.S. Appl. No. 14/315,879, entitled "Building Panel With a Mechanical Locking System," filed Jun. 26, 2014.

LifeTips, "Laminate Flooring Tips," available at (http://flooring.lifetips.com/cat/61734/laminate-flooring-tips/index.html), 2000, 12 pages.

Pervan, Darko, et al., U.S. Appl. No. 14/701,959 entitled "Mechanical Locking system for Floor Panels," filed May 1, 2015.

Pervan, Darko, U.S. Appl. No. 14/646,567 entitled "Mechanical Locking System for Floor Panels," filed May 21, 2015.

Pervan, Darko, U.S. Appl. No. 14/730,691 entitled "Mechanical Locking System for Panels and Method for Installing Same," filed Jun. 4, 2015.

Derelov, Peter, U.S. Appl. No. 14/709,913 entitled "Building Panel with a Mechanical Locking System," filed May 12, 2015.

Pervan, Darko, U.S. Appl. No. 14/938,612, entitled "Mechanical Locking System for Floor Panels," filed Nov. 11, 2015.

Pervan, Darko, U.S. Appl. No. 14/951,976, entitled "Mechanical Locking System for Floor Panels," filed Nov. 25, 2015.

Pervan, Darko, et al., U.S. Appl. No. 14/962,291, entitled "Mechanical Locking System for Floor Panels," filed Dec. 8, 2015.

Pervan, Darko, et al., U.S. Appl. No. 15/048,252, entitled "Mechanical Locking System for Floor Panels," filed in the U.S. Patent and Trademark Office Feb. 19, 2016.

Pervan, Darko, U.S. Appl. No. 15/148,820, entitled "Mechanical Locking System for Panels and Method of Installing Same," filed in the U.S. Patent and Trademark Office May 6, 2016.

* cited by examiner

KNOWN ART

KNOWN ART

Fig. 5a
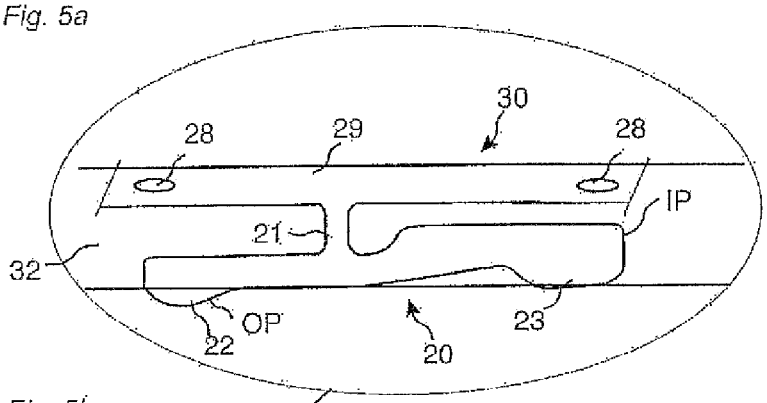
Fig. 5b
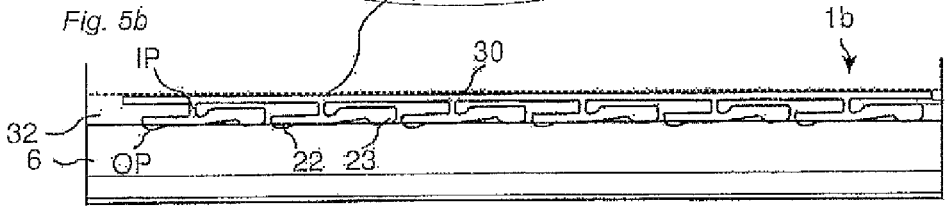
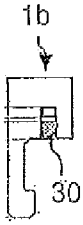
Fig. 5e
Fig. 5c
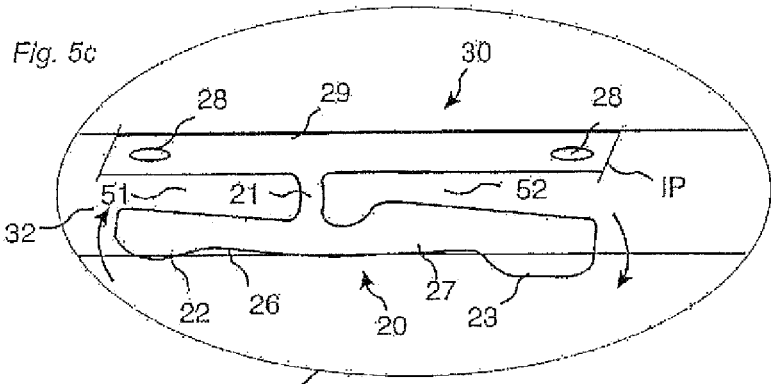
Fig. 5d
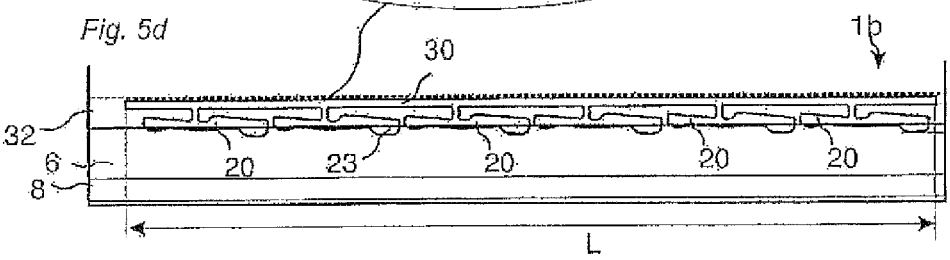
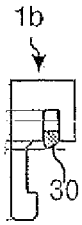
Fig. 5f Fig. 6a
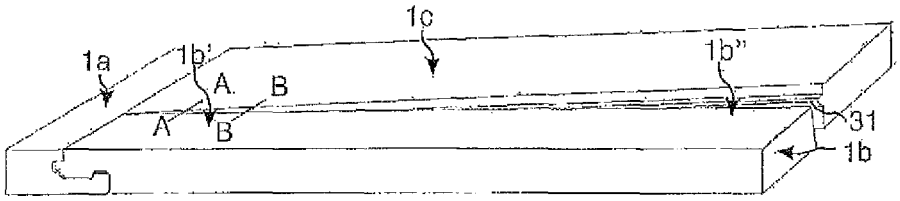
Fig. 6b
Fig. 6c
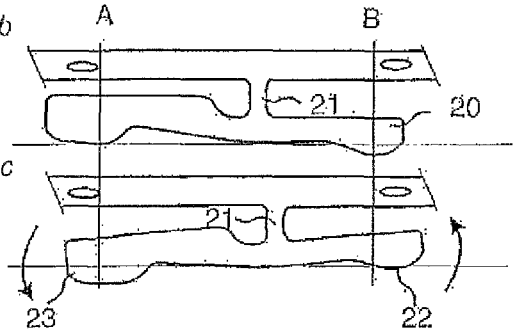
Fig. 6d
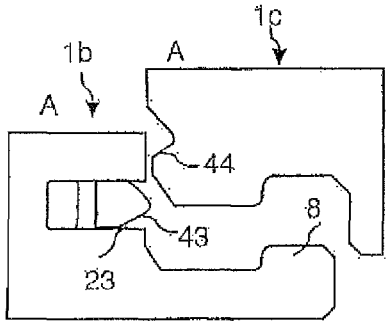
Fig. 6g
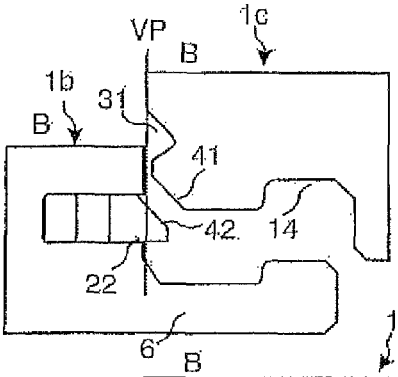
Fig. 6e
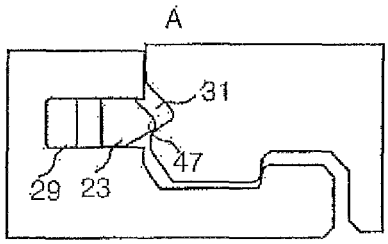
Fig. 6h
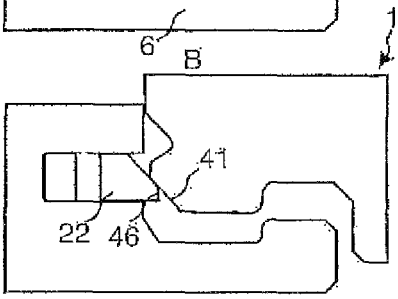
Fig. 6f
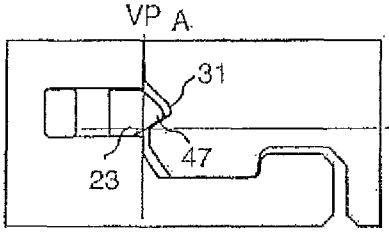
Fig. 6i
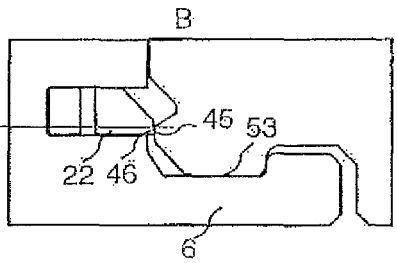

MECHANICAL LOCKING SYSTEM FOR FLOOR PANELS

CROSS REFERENCE TO RELATED APPLICATIONS

The present application is a continuation of U.S. application Ser. No. 13/577,042, filed on Sep. 27, 2012, which is a U.S. National Stage of International Application No. PCT/SE2011/050116, filed on Feb. 3, 2011, which claims the benefit of Swedish Application No. 1050111-2, filed on Feb. 4, 2010. The entire contents of each of U.S. application Ser. No. 13/577,042, International Application No. PCT/SE2011/050116, and Swedish Application No. 1050111-2 are hereby incorporated herein by reference in their entirety.

TECHNICAL FIELD

Embodiments of the invention generally relate to the field of mechanical locking systems for floor panels and building panels especially floor panels with mechanical locking systems, which are possible to lock with a vertical folding.

FIELD OF APPLICATION OF THE INVENTION

Embodiments of the present invention are particularly suitable for use in floating floors, which are formed of floor panels which are joined mechanically with a locking system integrated with the floor panel, i.e. mounted at the factory, that are made up of one or more upper layers of veneer, decorative laminate, solid powder based surfaces, decorative plastic material and similar surfaces, an intermediate core of wood fibre based material or plastic material and preferably a lower balancing layer on the rear side of the core. The following description of known technology, problems of known systems and objects and features of the invention will therefore, as a nonrestrictive example, be aimed above all at this field of application and in particular at floating flooring formed as rectangular floor panels with long and shorts sides intended to be mechanically joined on both long and short sides. The long and short sides are mainly used to simplify the description of the invention. The panels can be squared and can have more than four sides, which are not parallel or perpendicular to each other.

It should be emphasized that the invention can be applied to any floor panel and it could be combined with all types of known locking system, where the floor panels are intended to be joined using a mechanical locking system connecting the panels in the horizontal and/or vertical directions on at least two adjacent sides. The invention can thus also be applicable to, for instance, solid wooden floors, parquet floors with a core of wood or wood fibre based material and a surface of wood or wood veneer and the like, floors with a printed and preferably also varnished surface, floors with a surface layer of plastic or cork, linoleum, rubber or similar and with core material that do not comprise wood material for example plastic or mineral fibres and similar. Even floors with hard surfaces such as stone, ceramics and similar are included and floorings with soft wear layer, for instance needle felt glued to a board. The invention can also be used for joining building panels which preferably contain a board material for instance wall panels, ceilings, furniture components and similar.

BACKGROUND OF THE INVENTION

Laminate flooring usually comprises a core of 6-12 mm fibreboard; a 0.1-0.8 mm thick upper decorative surface layer of laminate and a 0.1-0.6 mm thick lower balancing layer of laminate, plastic, paper or like material. A laminate surface may comprise a melamine impregnated paper. Recently printed surfaces and wood fibre based paper free laminate surfaces have been developed. The most common core material is fibreboard with high density and good stability usually called HDF—High Density Fibreboard. Sometimes also MDF—Medium Density Fibreboard—is used as core.

Floating laminate and wood floor panels are generally joined mechanically by means of so called mechanical locking systems. These systems comprise locking means, which lock the panels horizontally and vertically. The mechanical locking systems are usually formed by machining the core of the panel. Alternatively, parts of the locking system can be formed of separate materials, which are integrated with the floor panel, i.e. joined with the floor panel in connection with the manufacture thereof.

The main advantages of floating floors with mechanical locking systems are that they are easy to install. They can also easily be taken up again and used once more at a different location. Although many improvements of production cost and function have been accomplished over the years, there is still a need for further improvements.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane (HP) or principal plane" is meant a plane, which extends parallel to the outer part of the surface layer. Immediately juxtaposed upper parts of two adjacent joint edges of two joined floor panels together define a "vertical plane (VP)" perpendicular to the horizontal plane. By "horizontally" is meant parallel to the horizontal plane and by "vertically" parallel to the vertical plane. By "up or upwardly" is meant towards the front side and by "down or downwardly" is meant towards the rear side. By "inwardly" is meant essentially horizontally towards the inner part of the panel and by outwardly is meant essentially horizontally and away from the inner part of the panel. By "strip panel" is meant a panel comprising a strip and a locking element. By "groove panel" is meant a panel with a locking groove intended to cooperate with a locking element for horizontal locking.

KNOWN TECHNOLOGY AND PROBLEMS THEREOF

The description of the known technology below is in applicable parts also used in embodiments of the invention.

For mechanical joining of long sides as well as short sides in the vertical and horizontal direction several methods and locking systems could be used. One of the most used methods is the angle-snap method and one of the most used locking systems is a system made in one piece with the core. The long sides are installed and locked by angling. The panel is then displaced, while in the in locked position, along the long side. The short sides are locked by horizontal snapping.

An alternative method is the so-called angling-angling method whereby long and short sides are locked with angling.

Recently a new and simpler method has been developed where all floor panels can be joined with just an angling of the long edges. This installation method generally referred to as vertical folding, is described in FIGS. 1*a*-4*b*.

A new panel 1*c* is locked to a previously installed first panel 1*a* with angling. This angling action connects automatically one short edge of the new panel 1*c* with an adjacent short edge of a second panel 1*b*, which is installed and locked to the first panel 1*a*. The vertical and horizontal locking of the short edges of the panels 1*b*, 1*c* takes place with a vertical turning scissors like motion where a flexible tongue 30 is displaced inwardly gradually from one edge to the other edge when a long side of a new panel 1*c* is connected by angling to a long edge of a first panel 1*a* previously installed in an adjacent row. The flexible tongue, which in most cases is made of a plastic section, snaps and locks automatically during folding of the new panel 1*c* when it is angled down to the subfloor. The displaceable tongue is displaced twice, first inwardly into a displacement groove 32 and then outwardly into a tongue grove 31. The flexibility is caused by a horizontal bending of the tongue along the joint. A part of the flexible tongue is during folding pressed to its inner position, as shown in FIGS. 2*a* and 2*b* and other parts are in a completely unlocked position. The flexible tongue snaps into a final locked position when both edges of the panels 1*b*, 1*c* are in the same plane as shown by FIGS. 3*a* and 3*b* and locks vertically. A strip 6 with a locking element 8 cooperates with a locking groove 14 and locks the panels horizontally.

The flexible tongue is generally connected to an edge of the strip panel 1*b*. It could also be connected to the groove panel 1*c*. One of the most used tongues on the market is a bristle tongue 30, as shown in FIGS. 4*a* and 4*b*, that has an inner part comprising several flexible protrusions 10 and an outer rigid part 30'.

The main problems with known flexible tongues are that the tongue must be made of materials that are rather flexible, that the snapping creates a resistance during folding and that the major part the tongue must be displaced in a groove during locking.

The function of a fold down locking system of the kind described above could be improved if locking could be made without a two-ways snapping action described above and with only limited displacement and material bending. It would be an advantage if the tongue could be connected into a groove in a rather fixed manner.

There are known systems that could be locked with vertical turning combined with twisting as shown in for example WO 2008/004960, FIG. 6 (Välinge Innovation AB). There are several disadvantages related to such locking systems. The tongue is difficult to connect into a groove since the whole tongue must turning vertically during locking. A major part of the tongue is exposed towards an open groove. This makes the whole locking system very sensitive to cutting of the panel across the joint and the tongue could easily be damaged or fall out from the groove. The tongue could also turn during transportation and material handling. A considerable amount of material must be removed in order to form cavities or groove that could house such turn snap systems. This affects the stability of the edge in a negative way.

SUMMARY OF THE INVENTION

A basic objective of embodiments of the present invention is to provide an improved mechanical locking system comprising a tongue that locks automatically during folding without any snapping parts that are displaced inwardly and outwardly during locking.

A first specific objective of embodiments is to create a non-snapping tongue with a simple cross section that could be connected in a horizontally extending fixation groove with limited depth, which surrounds and protects a major part of the tongue.

A second specific objective of embodiments is to create a tongue where the main part of the tongue could be fixed firmly into a groove and were only parts of the tongue are displaced inside and/or outside the fixation groove.

The above objects of embodiments of the invention are achieved wholly or partly by a mechanical locking systems and floor panels, according to the independent claim. Embodiments of the invention are evident from the dependent claims and from the description and drawings.

According to a first aspect of the invention, a set of floor panels are provided which are mechanically connectable to each other along one pair of adjacent edges by a vertical turning motion, so that upper joint edges of said floor panels in the connected state define a vertical plane. Each of said floor panels comprising a tongue on a first edge of a panel having a length direction extending parallel with the first edge and a tongue groove on a second opposite edge of the panel for receiving the tongue of an adjacent panel for mechanically locking together said adjacent edges in a vertical direction. The tongue has an inner part mounted in a sideward open fixation groove in the first edge and an outer part extending beyond the vertical plane. The inner part is fixed in the sideward open fixation groove. The tongue comprises one or several rocker arms extending in the length direction of the tongue. Each rocker arm comprises a displaceable pressing protrusion that during locking is in contact with the second edge and a displaceable locking protrusion that in locked position cooperates with the tongue groove. The locking protrusions is displaced outwardly away from the main tongue body when the pressing protrusion is pressed and displaced inwardly towards the inner part of the tongue.

Said floor panels may further comprise a locking element formed in one piece with the panel at the first edge and a locking groove at the opposite second edge. The locking groove is open towards a rear side of the panel that faces a subfloor. The locking element and the locking groove form a horizontal mechanical connection perpendicularly to the vertical plane. The tongue preferably comprises resilient parts, formed of a separate material than the core. The panels may be mechanically joined together with vertical folding by displacement of said two panels towards each other with a combined vertical and turning motion. The pressing and the locking protrusion of each rocker arm are preferably positioned at different vertical and horizontal positions.

According to a second aspect of the invention a tongue is provided comprising a main tongue body having an elongated shape and a length direction. The tongue is intended to be connected into a groove formed in a building panel wherein the tongue comprises one or several rocker arms located along its length and extending in the length direction of the tongue. One part of the rocker arm is displaced outwardly away from the main tongue body when the another part of the rocker arm is pressed and displaced inwardly towards the main tongue body.

The above described locking system and the tongue allows that panels could be locked automatically during vertical folding or vertical displacement without any snapping parts that are active and that create snapping resistance. A strong locking could be obtained with a tongue that has limited flexibility and that is fixed into the fixing groove during production, transport and installation. Only a rather limited horizontal turning of the rocker arms is required to lock the panels vertically.

The embodiments and principles related to vertical locking could also be used to connect building panels with a horizontal displacement.

The tongue is preferably factory connected but it could of course be delivered separately in blanks or as a separate loose component and inserted into a groove during installation.

BRIEF DESCRIPTION OF THE DRAWINGS

FIGS. 5*a*-5*f* illustrate embodiments of the invention.

FIGS. 6*a*-6*i* illustrate vertical folding with rotating tongue parts.

DESCRIPTION OF EMBODIMENTS OF THE INVENTION

Figure 1A:
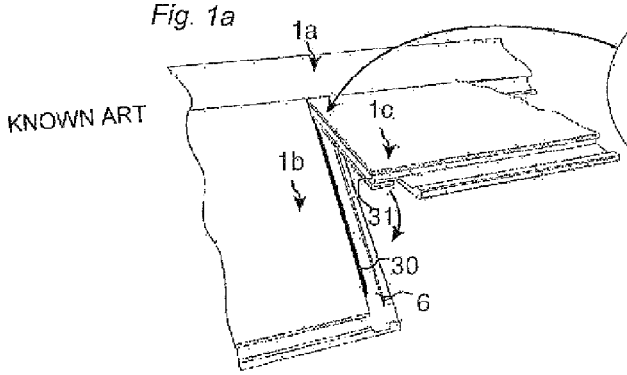
FIGS. 1*a*-4*b* illustrate known art.
Figure 1B:
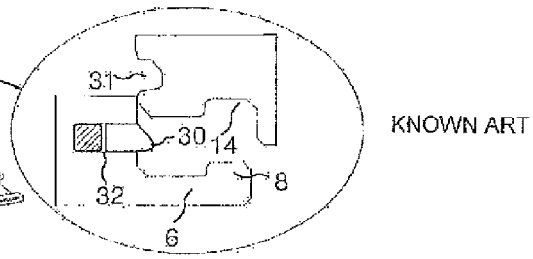
Figure 2A:
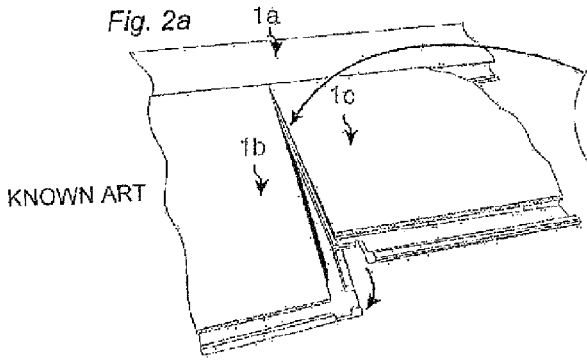
Figure 2B:
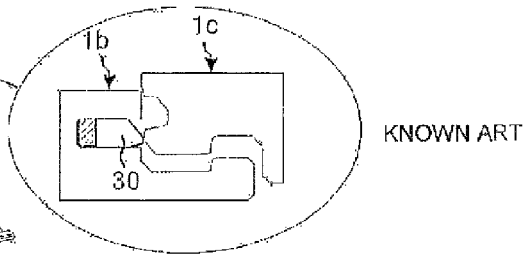
Figure 3A:
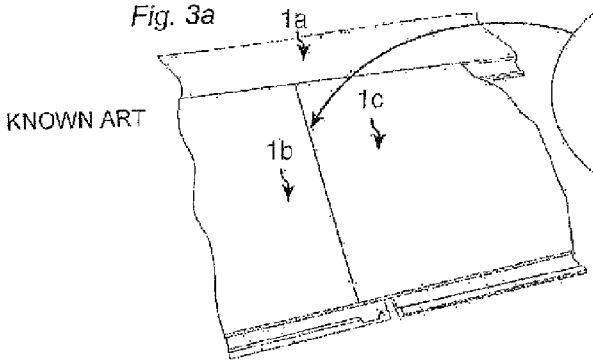
Figure 3B:
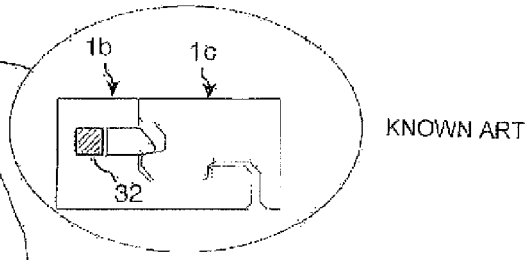
Figure 4A:
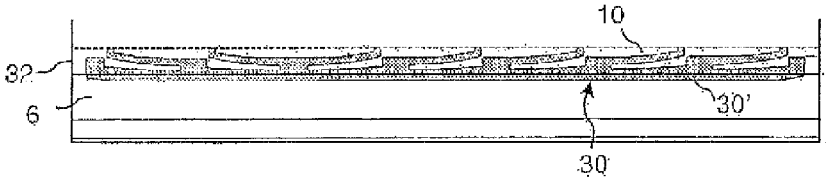
Figure 4B:
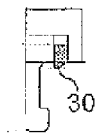

To facilitate understanding, several locking systems in the figures are shown schematically. It should be emphasized that improved or different functions can be achieved using combinations of the preferred embodiments.

FIGS. 5*a*-5*f* show a tongue 30 according to an embodiment of the invention. FIGS. 5*a*, 5*b* and 5*e* show a tongue 30, which is inserted into a fixation groove 32 of a panel 1*b*, comprises an inner part IP with a main tongue body 29 and a rocker arm 20 which is connected with a fastening device 21 to the main tongue body 29.

FIG. 5*c* shows that the rocker arm comprises a pressing protrusion 22 located on a pressing arm 26 and a locking protrusion 23 located on a locking arm 27. The rocker arm is designed such that the locking protrusion 23 is displaced outwardly away from the main tongue body 29 when the pressing protrusion 22 is pressed and displaced inwardly towards the main tongue body 29. The rocker arm is preferably designed such that it could turn horizontally about 3-10 degrees during locking. The turning is facilitated by a cavity 51, which is formed between the main tongue body 29 and the pressing arm 26 allowing the pressing arm to be turned and displaced inwardly towards the main tongue body. A cavity 52 is preferably also formed between the locking arm 27 and the main tongue body 29

Several rocker arms are preferably located along the length direction L of the tongue as shown in FIGS. 5*b* and 5*d*. The rocker arms could have different shapes and lengths and some could be mirror shaped and oriented in different directions along the tongue. It is preferred that the rocker arms have a length, which exceeds the depth of the fixation groove 32.

The tongue is preferably connected to the fixation groove 32 with friction connections 28. Several tongues could be connected into a groove along the edge but also over and under each other. The friction connections 28 could be designed such that the tongue is connected in a rather loose way or in a rather fixed way with firm friction. Even glue or snapping connections, where the core material is bended or compressed, could be used to fix the tongue into the fixation groove 32. The friction 28 connections could be located on protruding parts that could flex vertically in order to eliminate production tolerances.

FIGS. 6*a*-6*i* show vertical folding and a connection of two adjacent edges of the panels 1*b*, 1*c* with a combined vertical and turning motion. The tongue is preferably connected to the strip panel 1*b* comprising a strip 6 with a locking element 8 that cooperates with a locking groove 14 in an adjacent panel edge for horizontal locking of the edges. The tongue could also be connected to the groove panel comprising the locking groove 14 and a tongue groove 31. FIGS. 6*d* and 6*g* show two cross sections A-A and B-B of two adjacent edges of the panels 1*b* and 1*c* in an unlocked position. A-A is a cut at the locking protrusion 23 and B-B is a cut at pressing protrusion 22 that is also shown in FIGS. 6*b* and 6*c*. The locking protrusion 23 is in its inner position and the pressing protrusion 22 is in its outer position and protrudes beyond the vertical plane VP. The groove panel 1*c* comprises preferably a lower sliding surface 41, preferably formed as a bevel, that cooperates with a preferably inclined or rounded upper surface 42 of the pressing protrusion 22.

FIGS. 6*e* and 6*h* show that the pressing protrusion 22 is pressed inwardly by a lower part of the grove panel 1*c*, preferably the lower sliding surface 41 and causes a turning motion of the rocker arm 20, as shown in FIGS. 6*b* and 6*c*, such that the locking protrusion 23 is displaced outwardly towards a tongue groove 31 formed in the adjacent edge. The turning is mainly accomplished with a bending of the resilient fastening device 21.

FIGS. 6*f* and 6*i* show cross sections of the edges in the locked position when the locking protrusion 23 is in contact with the tongue groove 31 and locks the edges in a vertical direction parallel to the vertical plane VP. The pressing protrusion 22 is locked horizontally against a locking edge 45 of the groove panel 1*c*. The outer part 46 of the pressing protrusion 22 is preferably located below the outer part 47 of the locking protrusion 23.

The locking could be accomplished essentially with only a turning motion in essentially a horizontal plane. The pressing and locking protrusions are preferably turning in essentially the same plane. Such turning is facilitated if the tongue groove 31 and the locking protrusion 23 preferably have contact surfaces 43, 44 that are inclined in relation to the horizontal plane. Such inclination is preferably 10-50 degrees. It is an advantage if the tongue groove locking surface 44 is more inclined than the locking surface 43 of the locking protrusion 23.

The locking could also be combined with bending of the pressing and locking arms. The locking system could also be designed such that the locking protrusion creates a pressure against the adjacent edge during locking whereby the rocker arm is slightly bended during locking and/or in locked position. This pressure is released partly or completely when the tongue groove 31 is in a position that allows the outer part 47 of the locking protrusion to enter into the tongue groove 31.

It is preferred that the final locking is made with horizontal pre tension between the locking protrusion and the tongue groove. Such pre tension is used to overcome production tolerances and to press the adjacent edges of the panels 1*b*, 1*c* vertically towards each other in order to preferably accomplish a tight vertical fit between the strip 6 and the adjacent joint part 53 of the groove panel 1*c*.

The configuration of the rocking arms could be adapted to the contact angles of the adjacent edges during folding. FIG. 6*a* shows that a pressing against a pressing protrusion located close to the long side edge of the panel 1*b*' and at a distance from the other pressing protrusions starts at a higher angel than the pressing against a pressing protrusion located close to the opposite free long side edge of the panel 1*b*".

Long and short edges are used to simplify the description. The panels could be square.

Figure 7A:
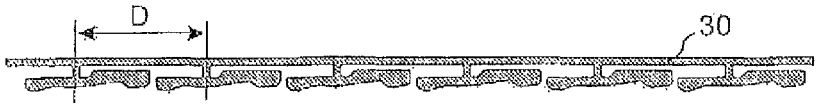
FIGS. 7*a*-7*e* illustrate a tongue blank and a second embodiment with an inclined displacement groove.
Figure 7B:
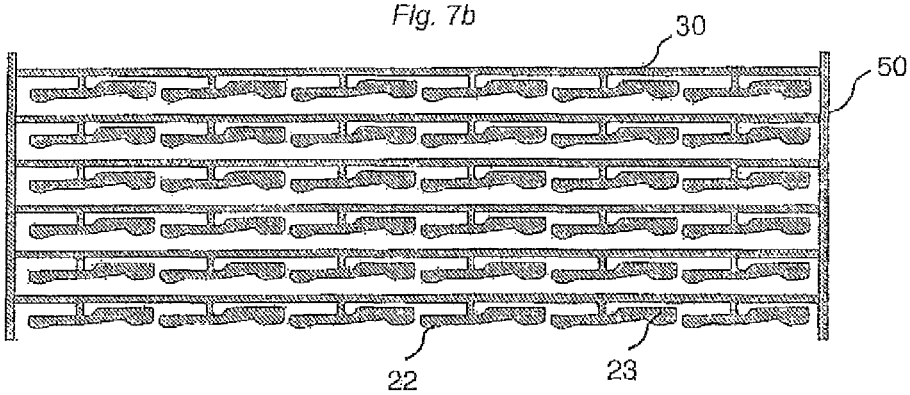

FIGS. 7*a*, 7*b* show a tongue and a tongue blank 50 comprising several tongues. Very advanced tongue shapes could be formed with injection moulded plastic components and each rocker arm could have an individual design. The cross section of a pressing and/or locking protrusion may vary between the rocking arms located along the tongue.

It is an advantage if the rocker arms are compacts and located close to each other such that a lot of locking protrusions are active during locking. In small and thick panels only one rocker arm could be sufficient. In most applications several rocker arms should be used. The distance D between the fastening devices 21 should preferably not exceed four times the floor thickness T. Very compact tongues could be made where the distance D between the fastening devices 21 is only about 2 times the floor thickness. This means that a locking system in a 7-10 mm laminate flooring could comprise several locking protrusion with a distance of about 2 cm and this gives a very strong vertical locking.

The distance between the fastening devices 21 along the tongue is preferably larger than the distance between the pressing and locking protrusions 22, 23.

Figure 7C:
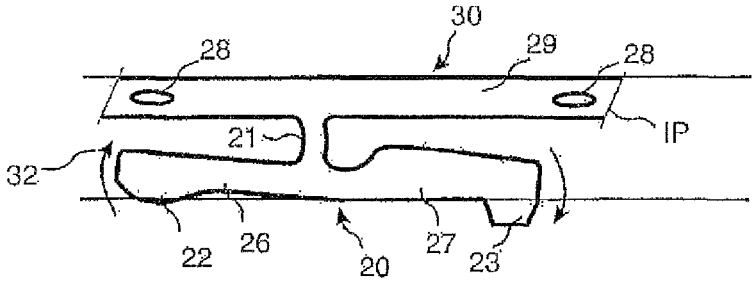

It is an advantage if the locking protrusion 23 is very compact as shown in FIG. 7*c*. The length of the pressing protrusion along the edge is preferably smaller than the floor thickness.

Figure 7D:
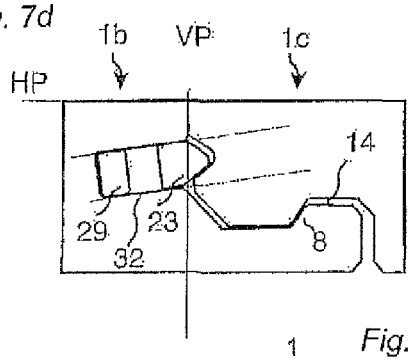
Figure 7E:
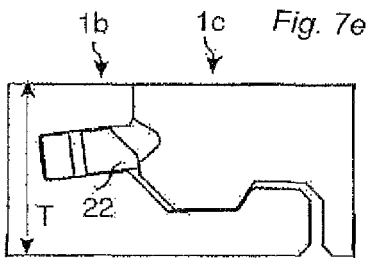

FIGS. 7*d* and 7*e* show that it could be an advantage if the fixation groove 32 is inclined against the horizontal plane HP. This facilitates the insertion of the tongue into the fixation groove and the turning of the pressing extension could be made with a lower pressing force. This embodiment comprises a locking element 8 and a locking groove 14 that have inclined cooperating locking surfaces. Such an embodiment could also be locked and unlocked with angling.

The principles described above could be used to provide locking systems that snaps in the same way as the known systems. The pressing and/or locking protrusion could be formed such that they are displaced inwardly and outwardly during locking such that they snap into a tongue groove.

Figure 7F:
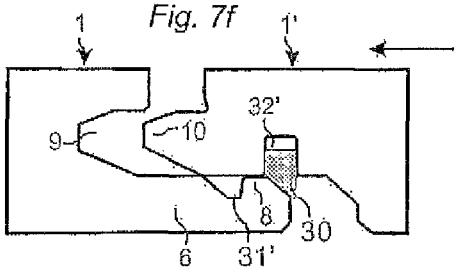
FIG. 7*f* illustrates a locking system that locks the edges with a horizontal motion.

FIG. 7*f* shows that all principles and embodiment described above could be used to lock floor panels horizontally with a horizontal displacement against each other. The tongue 30 is located in a vertically extending fixation groove 32' which could be formed in the groove panel 1' with its opening towards the rear side or on the strip panel 1 with its opening towards the front side. A tongue 10 and groove 9 could be used to lock the panels vertically. The rocker arms will in this embodiment turn or snap in a vertical plane. The fixation groove could be inclined and several rounded or beveled sliding surfaces could be used to facilitate the vertical rotation or snapping of the rocker arms.

All known materials that are described and used in fold down systems of the kind described in FIGS. 1*a*-4*b* could be used to form tongues according to the invention. The rocker tongues could be adapted to fit into a displacement groove of the known bristle tongues and the same inserting equipment could be used.

The rocker arms could of course be formed with one or two legs and in a way that they could be bended inwardly and outwardly during locking. Such a tongue could be used to connect floor panels with snapping actions where the rocker arms are displace inwardly and are snapping outwardly during locking.

The invention claimed is:

1. A set of floor panels which are mechanically connectable to each other along one pair of adjacent edges by a vertical motion, so that upper joint edges of said floor panels in the connected state define a vertical plane, each of said floor panels comprising:

a tongue on a first edge of a panel having a length direction extending parallel with the first edge;

a tongue groove on a second opposite edge of the panel for receiving the tongue of an adjacent panel for mechanically locking together said adjacent edges in a vertical direction;

wherein the tongue has an inner part mounted in a sideward open groove in the first edge and an outer part extending beyond the vertical plane, the inner part is fixed in the sideward open groove, wherein the tongue comprises at least one rocker arm extending in the length direction of the tongue, the at least one rocker arm comprising a displaceable pressing protrusion that during locking is in contact with the second edge and a displaceable locking protrusion that in locked position cooperates with the tongue groove, wherein the locking protrusion is displaced outwardly away from a main body of the tongue by the at least one rocker arm turning about an axis which is perpendicular to the length direction of the tongue when the pressing protrusion is pressed and displaced inwardly towards the inner part of the tongue.

2. The set of floor panels as claimed in claim 1, wherein the inner part of the tongue comprises the main body and the at least one rocker arm comprises a fastening device that connects the at least one rocker arm with the main body.

3. The set of floor panels as claimed in claim 2, wherein the fastening device is flexible and located between the pressing protrusion and the locking protrusion.

4. The set of floor panels as claimed in claim 1, wherein the pressing protrusion protrudes from a pressing arm and the locking protrusion protrudes from a locking arm.

5. The set of floor panels as claimed in claim 4, wherein the locking protrusion is locked against the tongue groove with pre tension.

6. The set of floor panels as claimed in claim 1, wherein the tongue groove is formed in a core of the panel and is open towards the vertical plane.

7. The set of floor panels as claimed in claim 1, wherein the floor panels are provided with a horizontal mechanical connection locking the panels horizontally perpendicularly to the vertical plane.

8. The set of floor panels as claimed in claim 7, wherein the horizontal mechanical connection comprises a locking element formed in one piece with the panel at the first edge and a locking groove at the opposite second edge, the locking groove being open towards a rear side of the panel that faces a subfloor.

9. The set of floor panels as claimed in claim 1, wherein opposed first and second edges of the floor panels are mechanically connectable by vertical folding, a combined vertical and turning motion.

10. The set of floor panels as claimed in claim 1, wherein the tongue comprises resilient parts formed of a separate material than a core of the panel.

11. The set of floor panels as claimed in claim 10, wherein the resilient parts are formed of an injection moulded plastic material.

12. The set of floor panels as claimed in claim 1, wherein the sideward open groove is open towards the vertical plane.

13. The set of floor panels as claimed in claim 1, wherein the pressing protrusion comprises the outer part of the tongue in an unconnected state and the locking protrusion comprises the outer part in a connected state.

14. The set of floor panels as claimed in claim 1, wherein the sideward open groove is inclined to a front side of the floor panel.

15. The set of floor panels as claimed in claim 1, wherein the tongue comprises two rocker arms, and the two rocker arms are spaced from each other in the length direction of the tongue.

* * * * *